US009360185B2

(12) United States Patent
Demuynck et al.

(10) Patent No.: US 9,360,185 B2
(45) Date of Patent: Jun. 7, 2016

(54) VARIABLE BEAM ANGLE DIRECTIONAL LIGHTING FIXTURE ASSEMBLY

(75) Inventors: Randolph Cary Demuynck, Wake Forest, NC (US); Dong Lu, Cary, NC (US)

(73) Assignee: CREE, INC., Durham, NC (US)

( * ) Notice: Subject to any disclaimer, the term of this patent is extended or adjusted under 35 U.S.C. 154(b) by 482 days.

(21) Appl. No.: 13/442,746

(22) Filed: Apr. 9, 2012

(65) Prior Publication Data

US 2013/0265760 A1 Oct. 10, 2013

(51) Int. Cl.

| | |
|---|---|
| ***F21V 13/04*** | (2006.01) |
| ***F21V 5/00*** | (2015.01) |
| ***F21K 99/00*** | (2016.01) |
| ***F21V 7/00*** | (2006.01) |

(52) U.S. Cl.

CPC . *F21V 5/004* (2013.01); *F21K 9/13* (2013.01); *F21V 5/007* (2013.01); *F21V 7/0091* (2013.01); *F21V 13/04* (2013.01)

(58) Field of Classification Search

CPC ..... F21V 7/0083; F21V 7/0091; F21V 7/04; F21V 13/00; F21V 13/02; F21V 13/04; F21V 5/002; F21V 5/004; F21V 5/007; F21K 9/00; F21K 9/10; F21K 9/13

USPC ..... 362/237, 240, 241, 244, 245, 246, 362/249.01, 249.02, 268, 296.1, 307, 308, 362/311.02

See application file for complete search history.

(56) References Cited

U.S. PATENT DOCUMENTS

| | | | | |
|---|---|---|---|---|
| D85,382 | S | 10/1931 | Guth | D26/24 |
| 2,356,654 | A | 8/1944 | Cullman | 362/223 |
| 3,381,124 | A | 4/1968 | Eisenberg | 362/354 |
| 4,939,627 | A | 7/1990 | Herst et al. | 362/299 |
| 5,025,356 | A | 6/1991 | Gawad | 362/221 |
| 5,823,663 | A | 10/1998 | Bell et al. | 362/362 |
| D407,473 | S | 3/1999 | Wimbock | D23/328 |
| 6,149,283 | A | 11/2000 | Conway et al. | 41/362 |
| 6,155,699 | A | 12/2000 | Miller et al. | 362/293 |
| 6,210,025 | B1 | 4/2001 | Schmidt et al. | 362/362 |
| 6,234,643 | B1 | 5/2001 | Lichon, Jr. | 362/147 |

(Continued)

FOREIGN PATENT DOCUMENTS

| | | |
|---|---|---|
| CN | 1762061 | 4/2006 |
| CN | 1934389 | 3/2007 |

(Continued)

OTHER PUBLICATIONS

International Search Report and Written Opinion for PCT Application No. PCT/US2011/062396, dated Jul. 13, 2012.

(Continued)

*Primary Examiner* — Thomas M Sember

(74) *Attorney, Agent, or Firm* — Koppel, Patrick, Heybl & Philpott

(57) ABSTRACT

A directional lighting fixture having a variable beam angle that is easily adjusted. One or more lighting sources are disposed within a fixture housing. A removable cover is disposed over the open end of the housing. The cover comprises a micro lens structure that defines the beam angle of the light that is emitted from the fixture. The removable cover, or in some configurations portions of the cover, can be easily replaced by the end user to achieve a desired beam angle.

39 Claims, 5 Drawing Sheets

(56) References Cited

U.S. PATENT DOCUMENTS 6,402,347 B1 * 6/2002 Maas et al. ..... 362/294
6,443,598 B1 9/2002 Morgan ..... 362/342
6,523,974 B2 2/2003 Engel ..... 362/224
6,578,979 B2 6/2003 Truttmann-Battig ..... 362/92
D496,121 S 9/2004 Santoro ..... D26/74
6,871,983 B2 3/2005 Jacob et al. ..... 362/364
6,948,840 B2 9/2005 Grenda et al. ..... 362/555
7,021,797 B2 4/2006 Minano et al. ..... 362/355
7,049,761 B2 5/2006 Timmermans et al. ..... 315/246
7,063,449 B2 6/2006 Ward ..... 345/102
7,175,296 B2 2/2007 Cok ..... 362/147
7,213,940 B1 5/2007 Van de Ven et al. ..... 362/231
7,217,004 B2 5/2007 Park et al. ..... 362/240
7,237,924 B2 7/2007 Martineau et al. ..... 362/231
D556,358 S 11/2007 Santoro ..... D26/74
7,338,182 B1 3/2008 Hastings et al. ..... 362/150
7,510,299 B2 3/2009 Timmermans et al. ..... 362/225
7,520,636 B2 4/2009 Van der Poel ..... 362/290
D593,246 S 5/2009 Fowler et al. ..... D26/76
7,559,672 B1 7/2009 Parkyn et al. ..... 362/244
7,594,736 B1 9/2009 Kassay et al. ..... 362/223
D604,446 S 11/2009 Fowler et al. ..... D26/76
7,618,157 B1 11/2009 Galvez et al. ..... 362/294
7,618,160 B2 11/2009 Chinniah et al. ..... 362/326
D608,932 S 1/2010 Castelli ..... D26/76
7,654,702 B1 2/2010 Ding et al. ..... 362/294
7,661,844 B2 2/2010 Sekiguchi et al. ..... 362/249
D611,183 S 3/2010 Duarte ..... D26/76
7,674,005 B2 3/2010 Chung et al. ..... 362/223
7,686,470 B2 3/2010 Chiang ..... 362/147
7,686,484 B2 3/2010 Heiking et al. ..... 362/375
7,712,918 B2 5/2010 Siemiet et al. ..... 362/241
7,722,220 B2 5/2010 Van de Ven
7,722,227 B2 5/2010 Zhang et al. ..... 362/364
D617,487 S 6/2010 Fowler et al. ..... D26/76
7,768,192 B2 8/2010 Van de Ven et al. ..... 313/503
7,815,338 B2 10/2010 Siemiet et al. ..... 362/218
7,824,056 B2 11/2010 Madireddi et al. ..... 362/125
7,828,468 B2 11/2010 Mayfield et al. ..... 362/342
D633,247 S 2/2011 Kong et al. ..... D26/88
7,887,216 B2 2/2011 Patrick et al.
7,922,354 B2 4/2011 Everhart ..... 362/235
7,926,982 B2 4/2011 Liu ..... 362/294
7,988,321 B2 8/2011 Wung et al. ..... 362/218
7,988,335 B2 8/2011 Liu et al. ..... 362/294
7,991,257 B1 8/2011 Coleman
7,993,034 B2 8/2011 Wegner ..... 362/296.05
7,997,762 B2 8/2011 Wang et al. ..... 362/249
8,038,314 B2 10/2011 Ladewig
8,038,321 B1 10/2011 Franck et al. ..... 362/249.02
8,070,326 B2 12/2011 Lee ..... 362/307
D653,376 S 1/2012 Kong et al. ..... D26/76
8,092,043 B2 1/2012 Lin et al. ..... 362/249.02
8,092,049 B2 1/2012 Kinnune et al. ..... 362/294
8,096,671 B1 1/2012 Cronk ..... 362/147
D657,488 S 4/2012 Lown et al. ..... D26/120
8,162,504 B2 4/2012 Zhang et al. ..... 362/217
8,186,855 B2 5/2012 Wassel et al. ..... 362/373
8,197,086 B2 6/2012 Watanabe et al. ..... 362/218
8,201,968 B2 6/2012 Maxik et al.
8,215,799 B2 7/2012 Vanden Eynden et al. ... 362/294
8,246,219 B2 8/2012 Teng et al. ..... 362/311.03
8,256,927 B2 9/2012 Hu ..... 362/218
D670,849 S 11/2012 Lay et al. ..... D26/74
8,317,354 B2 11/2012 Gassner et al. ..... 362/147
D679,848 S 4/2013 Pickard et al. ..... D26/74
8,410,514 B2 4/2013 Kim ..... 257/99
D684,291 S 6/2013 Goelz et al. ..... 26/74
8,480,252 B2 7/2013 Bertram et al. ..... 362/243
8,506,135 B1 8/2013 Oster ..... 362/373
8,591,058 B2 11/2013 Concepcion ..... 362/231
8,591,071 B2 11/2013 Hochstein ..... 362/294
D698,975 S 2/2014 Blessitt et al. ..... D26/74
8,641,243 B1 2/2014 Rashidi ..... 362/373
D701,988 S 4/2014 Clements ..... D26/74
8,696,154 B2 4/2014 Hutchens ..... 362/217.05
8,702,264 B1 4/2014 Rashidi ..... 362/147
8,764,244 B2 7/2014 Jeon ..... 362/218
D714,988 S 10/2014 Park et al. ..... D26/74
D721,198 S 1/2015 Glasbrenner ..... D26/76
9,052,075 B2 6/2015 Demuynck et al.
2003/0063476 A1 4/2003 English et al.
2004/0001344 A1 1/2004 Hecht ..... 362/555
2004/0085779 A1 * 5/2004 Pond et al. ..... 362/516
2004/0100796 A1 5/2004 Ward
2004/0240230 A1 12/2004 Kitajima ..... 362/558
2005/0180135 A1 8/2005 Mayer ..... 362/240
2005/0264716 A1 12/2005 Kim et al.
2005/0281023 A1 12/2005 Gould ..... 362/217
2006/0221611 A1 10/2006 Noh et al. ..... 362/247
2006/0262521 A1 11/2006 Piepgras et al. ..... 362/149
2006/0291206 A1 * 12/2006 Angelini et al. ..... 362/244
2007/0070625 A1 3/2007 Bang ..... 362/240
2007/0109779 A1 5/2007 Sekiguchi et al.
2007/0211457 A1 9/2007 Mayfield et al. ..... 362/223
2007/0253205 A1 11/2007 Welker ..... 362/373
2007/0297181 A1 12/2007 Mayfield et al. ..... 362/342
2008/0019147 A1 1/2008 Erchak ..... 362/607
2008/0049422 A1 2/2008 Trenchard et al. ..... 362/238
2008/0232093 A1 9/2008 Kim ..... 362/147
2008/0278943 A1 11/2008 Van Der Poel ..... 362/240
2009/0034247 A1 2/2009 Boyer ..... 362/225
2009/0073693 A1 3/2009 Nall
2009/0161356 A1 6/2009 Negley et al. ..... 362/231
2009/0168439 A1 7/2009 Chiang ..... 362/404
2009/0196024 A1 8/2009 Heiking et al. ..... 362/150
2009/0237958 A1 9/2009 Kim
2009/0262543 A1 10/2009 Ho ..... 362/373
2009/0296388 A1 12/2009 Wu et al. ..... 362/235
2009/0310354 A1 12/2009 Zampini et al. ..... 362/235
2010/0061108 A1 3/2010 Zhang et al. ..... 362/364
2010/0097794 A1 4/2010 Teng et al. ..... 362/231
2010/0103678 A1 4/2010 Van De Ven et al. ..... 362/294
2010/0110679 A1 5/2010 Teng et al.
2010/0172133 A1 7/2010 Lie ..... 362/235
2010/0177532 A1 7/2010 Simon et al.
2010/0188609 A1 7/2010 Matsuki et al.
2010/0253591 A1 * 10/2010 Hwu et al. ..... 345/1.3
2010/0254128 A1 10/2010 Pickard et al.
2010/0254145 A1 10/2010 Yamaguchi
2010/0254146 A1 10/2010 McCanless
2010/0270903 A1 10/2010 Jao et al. ..... 313/46
2010/0271843 A1 10/2010 Holten et al. ..... 362/609
2010/0277905 A1 11/2010 Janik et al. ..... 362/235
2010/0295468 A1 11/2010 Pederson et al. ..... 315/294
2010/0327768 A1 12/2010 Kong et al. ..... 315/294
2011/0032714 A1 2/2011 Chang ..... 362/373
2011/0043132 A1 2/2011 Kim et al.
2011/0090671 A1 4/2011 Bertram et al. ..... 362/84
2011/0141722 A1 6/2011 Acampora et al. ..... 362/218
2011/0141734 A1 6/2011 Li et al. ..... 362/235
2011/0156584 A1 6/2011 Kim ..... 315/32
2011/0164417 A1 7/2011 Huang ..... 362/235
2011/0175533 A1 7/2011 Holman ..... 315/130
2011/0199005 A1 8/2011 Bretschneider et al.
2011/0199769 A1 8/2011 Bretschneider et al.
2011/0246146 A1 * 10/2011 Kauffman et al. ..... 703/2
2011/0255292 A1 10/2011 Shen ..... 362/311
2011/0267810 A1 11/2011 Higman et al. ..... 362/218
2011/0267823 A1 * 11/2011 Angelini et al. ..... 362/277
2011/0305024 A1 12/2011 Chang ..... 362/294
2012/0033420 A1 2/2012 Kim et al. ..... 362/235
2012/0038289 A1 2/2012 Jee et al. ..... 315/291
2012/0051041 A1 3/2012 Edmond et al. ..... 362/231
2012/0127714 A1 5/2012 Rehn
2012/0134146 A1 5/2012 Smith ..... 362/225
2012/0140442 A1 6/2012 Woo ..... 362/95
2012/0140461 A1 6/2012 Pickard
2013/0235568 A1 9/2013 Green et al. ..... 362/218
2013/0258652 A1 10/2013 Hsieh ..... 362/225
2014/0265930 A1 9/2014 Harris ..... 315/307
2015/0016100 A1 1/2015 Ishii ..... 362/223

(56) References Cited

U.S. PATENT DOCUMENTS

FOREIGN PATENT DOCUMENTS

| | | | |
|---|---|---|---|
| CN | 1963289 | A | 5/2007 |
| CN | 101188261 | | 5/2008 |
| CN | 10166071 5 | | 3/2010 |
| CN | 101776254 | | 7/2010 |
| CN | 101790660 | | 7/2010 |
| CN | 102072443 | | 5/2011 |
| CN | 202580962 | | 12/2012 |
| DE | 102007030186 | | 1/2009 |
| DE | 202010001832 | | 7/2010 |
| EP | 1298383 | A2 | 4/2003 |
| EP | 1357335 | A2 | 10/2003 |
| EP | 1653254 | | 3/2006 |
| EP | 1737051 | | 12/2006 |
| EP | 1847762 | A2 | 10/2007 |
| EP | 1860467 | | 11/2007 |
| EP | 2287520 | A2 | 2/2011 |
| EP | 2290690 | A2 | 3/2011 |
| EP | 2636945 | A2 | 9/2013 |
| GB | 774198 | | 5/1957 |
| JP | 1069809 | | 3/1998 |
| JP | 2002244027 | | 11/2002 |
| JP | U3097327 | | 8/2003 |
| JP | 2004140327 | | 5/2004 |
| JP | 2004345615 | | 12/2004 |
| JP | 2006173624 | | 6/2006 |
| JP | 2008147044 | | 6/2008 |
| JP | 3151501 | U | 6/2009 |
| JP | 2009295577 | | 12/2009 |
| JP | 2010103687 | | 5/2010 |
| JP | 2011018571 | | 8/2011 |
| JP | 2011018572 | | 8/2011 |
| TW | 200524186 | | 7/2005 |
| TW | 201018826 | | 5/2010 |
| WO | WO 03102467 | | 12/2003 |
| WO | WO 2009030233 | | 3/2009 |
| WO | WO 2009140761 | A1 | 11/2009 |
| WO | WO 2009157999 | | 12/2009 |
| WO | WO 2009157999 | A1 | 12/2009 |
| WO | WO 2010024583 | | 3/2010 |
| WO | WO 2010042216 | | 4/2010 |
| WO | WO 2010042216 | A2 | 4/2010 |
| WO | WO 2011074424 | A1 | 6/2011 |
| WO | WO 2011096098 | A1 | 8/2011 |
| WO | WO 2011098191 | | 8/2011 |
| WO | WO 2011118991 | A2 | 9/2011 |
| WO | WO 2011140353 | A2 | 11/2011 |

OTHER PUBLICATIONS

Office Action from U.S. Appl. No. 29/387,171. dated May 2, 2012.
Response to OA from U.S. Appl. No. 29/387,171, filed Aug. 2, 2012.
Office Action from U.S. Appl. No. 12/961,385, dated Apr. 26, 2013.
Response to OA from U.S. Appl. No. 12/961,385, filed Jul. 24, 2013.
Office Action from U.S. Appl. No. 13/464,745, dated Jul. 16, 2013.
Office Action from U.S. Appl. No. 29/368,970, dated Jun. 19, 2012.
Office Action from U.S. Appl. No. 29/368,970, dated Aug. 24, 2012.
Response to OA from U.S. Appl. No. 29/368,970, filed Nov. 26, 2012.
Search Report and Written Opinion from PCT Patent Appl. No. PCT/US2012/047084. dated Feb. 27, 2013.
Search Report and Written Opinion from PCT Patent Appl. No. PCT/US2012/071800, dated Mar. 25, 2013.
U.S. Appl. No. 12/873,303, filed Aug. 31, 2010 to Edmond. et al.
International Search Report and Written Opinion from Appl. No. PCT/CN2013/072772, dated Dec. 19, 2013.
Notice to Submit a Response from Korean Patent Application No. 30-2011-0038115, dated Dec. 12, 2012.
Notice to Submit a Response from Korean Patent Application No. 30-2011-0038116, dated Dec. 12, 2012.
Office Action from U.S. Appl. No. 13/464,745, dated Feb. 12, 2014.
Office Action from U.S. Appl. No. 13/453,924, dated Feb. 19, 2014.
Office Action from U.S. Appl. No. 13/341,741, dated Jan. 14, 2014.
Office Action from U.S. Appl. No. 13/370,252, dated Dec. 20, 2013.
Preliminary Report and Written Opinion from PCT appl. No. PCT/US2012/047084, dated Feb. 6, 2014.
Office Action from U.S. Appl. No. 13/429,080, dated Apr. 18, 2014.
Office Action from U.S. Appl. No. 12/961,385, dated Mar. 11, 2014.
Final Rejection issued in Korean Design Appl. No. 30-2011-0038114, dated Jun. 14, 2013.
Final Rejection issued in Korean Design Appl. No. 30-2011-0038115, dated Jun. 14, 2013.
Final Rejection issued in Korean Design Appl. No. 30-2011-0038116, dated Jun. 17, 2013.
International Search Report and Written Opinion from PCT Patent Appl. No. PCT/US2013/035668, dated Jul. 12, 2013.
Reasons for Rejection from Japanese Patent Appl. No. 2013-543207, dated May 20, 2014.
First Office Action from Chinese Patent Appl. No. 2011800529984, dated May 4, 2014.
Office Action from U.S. Appl. No. 13/544,662, dated May 5, 2014.
Office Action from U.S. Appl. No. 13/844,431, dated May 15, 2014.
Office Action from U.S. Appl. No. 13/341,741, dated Jun. 6, 2014.
International Search Report and Written Opinion from PCT Application No. PCT/US2013/021053, dated Apr. 17, 2013.
Office Action from U.S. Appl. No. 13/429,080, dated Sep. 16, 2014.
Office Action from U.S. Appl. No. 13/844,431, dated Oct. 10, 2014.
Office Action from U.S. Appl. No. 13/443,630, dated Oct. 10, 2014.
Office Action from U.S. Appl. No. 13/368,217, dated Oct. 22, 2014.
Office Action from U.S. Appl. No. 12/961,385, dated Nov. 6, 2014.
Office Action from U.S. Appl. No. 13/453,924, dated Nov. 7, 2014.
Decision of Rejection from Japanese Appl. No. 2013-543207, dated Nov. 25, 2014.
Office Action from Mexican Appl. No. 100881, dated Nov. 28, 2014.
Grant Notice from European Appl. No. 13701525.1-1757, dated Nov. 24, 2014.
Preliminary Report on Patentability from PCT/US2013/035668, dated Oct. 14, 2014.
International Preliminary Report on Patentabiliby from PCT/US2012/071800 dated Jul. 10, 2014.
Office Action from U.S. Appl. No. 13/189,535, dated Jun. 20, 2014.
Office Action from U.S. Appl. No. 13/453,924, dated Jun. 25, 2014.
Office Action from U.S. Appl. No. 13/443,630, dated Jul. 1, 2014.
Office Action from U.S. Appl. No. 13/787,727, dated Jan. 29, 2015.
Office Action from U.S. Appl. No. 13/429,080, dated Feb. 18, 2015.
Office Action from U.S. Appl. No. 13/453,924, dated Mar. 10, 2015.
US Publication No. US 2007/0115671, date: May 24, 2007 to Roberts et al.
US Publication No. US 2007/0115670, date: May 24, 2007 to Roberts et al.
US Publication No. US 2009/0323334, date: Dec. 31, 2009 to Roberts et al.
US Publication No. US 2009/0225543, date: Mar. 5, 2008 to Roberts et al.
U.S. Appl. No. 12/873,303, filed Aug. 31, 2010 to Edmond, et al.
U.S. Appl. No. 12/961,385, filed Dec. 6, 2010 to Pickard, et al.
Cree's XLamp XP-G LED's data sheet, pp. 1-12, no date.
International Search Report and Written Opinion for Patent Application No. PCT/US2011/001517, dated: Feb. 27, 2012.
Second Office Action and Search Report from Chinese Appl. No. 2011800529984, dated Dec. 26, 2014.
Grant Notice from European Appl. No. 13701525.1, dated Nov. 19, 2014.
International Report and Written Opinion from PCT/US2013/049225, dated Jan. 22, 2015.
Office Action from U.S. Appl. No. 13/828,348, dated Nov. 20, 2014.
Office Action from U.S. Appl. No. 12/873,303, dated Nov. 28, 2014.
Office Action from U.S. Appl. No. 13/464,745, dated Dec. 10, 2014.
Office Action from U.S. Appl. No. 13/341,741, dated Dec. 24, 2014.
Office Action from U.S. Appl. No. 13/189,535, dated Jan. 13, 2015.
Communication from European Patent Appl. No. 13701525.1-1757, dated Sep. 26, 2014.
First Official Action from European Patent Appl. No. 12 743 003.1-1757, dated Jan. 16, 2015.
Office Action from U.S. Appl. No. 13/464,745, dated Jul. 16, 2014.

(56) References Cited

OTHER PUBLICATIONS

International Preliminary Report on Patentability and Written Opinion from PCT/US2013/021053, dated Aug. 21, 2014.
First Office Action from Chinese Patent Appl. No 2012800369142, dated Mar. 26, 2015.
Office Action from U.S. Appl. No. 13/464,745, dated Apr. 2, 2015.
Office Action from U.S. Appl. No. 13/368,217, dated May 13, 2015.
Office Action from U.S. Appl. No. 13/828,348, dated May 27, 2015.
Office Action from U.S. Appl. No. 12/961,385, dated Nov. 27, 2015.
Office Action from U.S. Appl. No 13/828,348, dated Nov. 4. 2015.
Office Action from U.S. Appl. No. 14/020,757, dated Nov, 24, 2014.
First Office Action from Chinese Patent Appl No. 2011800588770, dated Sep. 25, 2015.
Notice of Completion of Pretrial Re-examination from Japanese Patent appl. No. 2013-543207. dated Jun. 30, 2015.
Pretrial Report from Japanese Appl. No. 2013-543207, dated Jun. 19, 2015.
Decision of Rejection from Chinese Patent Appl. No. 201180052998.4, dated Jul. 16, 2015.
Office Action from U.S. Appl. No. 12/873,303, dated Jun. 22, 2015.
Response to OA from U.S. Appl. No. 12/873,303, filed Aug. 21, 2015.
Office Action from U.S. Appl. No. 13/341,741, dated Jun. 22, 2015.
Office Action from U.S. Appl. No. 13/443,630, dated Jun. 23, 2015.
Response to OA from U.S. Appl. No. 13/443,630, filed Aug. 21, 2015.
Office Action from U.S. Appl. No. 13/189,535, dated Jul. 19, 2015.
Office Action from U.S. Appl. No. 13/453,924, dated Jul. 21, 2015.
Office Action from U.S. Appl. No. 14/020,757, dated Aug. 3, 2015.
Office Action from U.S. Appl. No. 13/429,080, dated Sep. 1, 2015.
Office Action from U.S. Appl. No. 14/716,480, dated Sep. 24, 2015.
Office Action from U.S. Appl. No. 14/170,627, dated Oct. 5, 2015.
Office Action from U.S. Appl. No. 13/368,217, dated Oct. 8, 2015.
Office Action from U.S. Appl. No. 13/464,745, dated Oct. 8, 2015.
Office Action from U.S. Appl. No. 29/466,391, dated Oct. 14, 2015.
International Search Report and Written Opinion from PCT/US2013/049225, dated Oct. 24, 2013.
Examination Report from Taiwanese Patent Appl. No. 100131021, dated Jan. 5, 2016.
Examination from European Patent Appl. No. 12743003.1.-1757, dated Jan. 8, 2016.
Notice of Reasons for Rejection from Japanese Patent Appl. No. 2013-543207, dated Feb. 2, 2016.
Examination from European Patent Appl. No. 13 701 525.1-1757, dated Feb. 3, 2016.
Office Action from U.S. Appl. No. 13/189,535; Jan. 6, 2016.
Office Action from U.S. Appl. No. 13/341,741; Jan. 8, 2016.
Office Action from U.S. Appl. No. 13/873,303; Feb. 2, 2016.

* cited by examiner

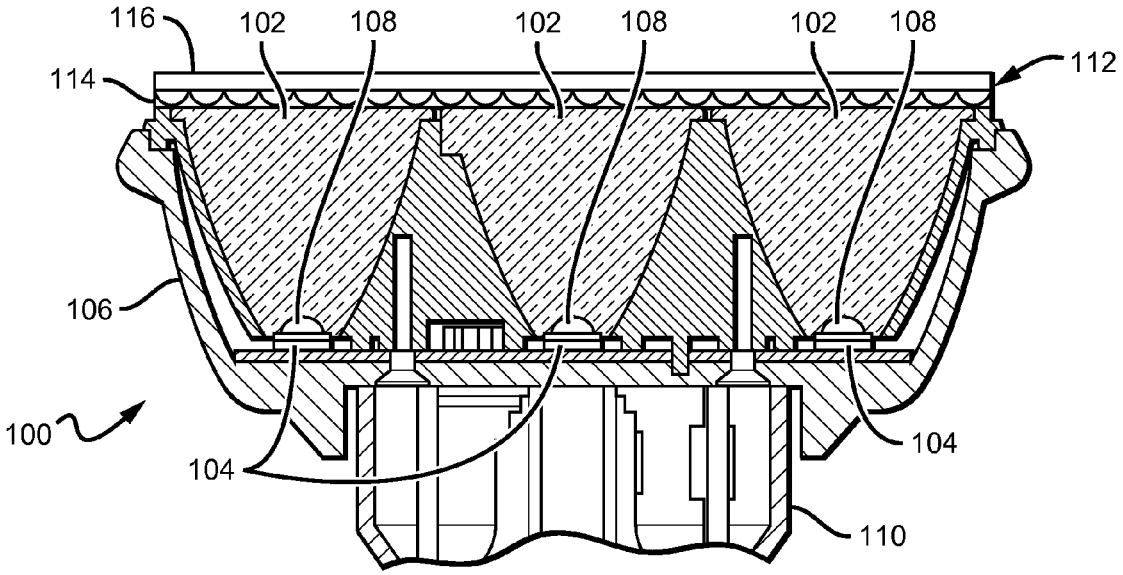
FIG. 1
FIG. 2
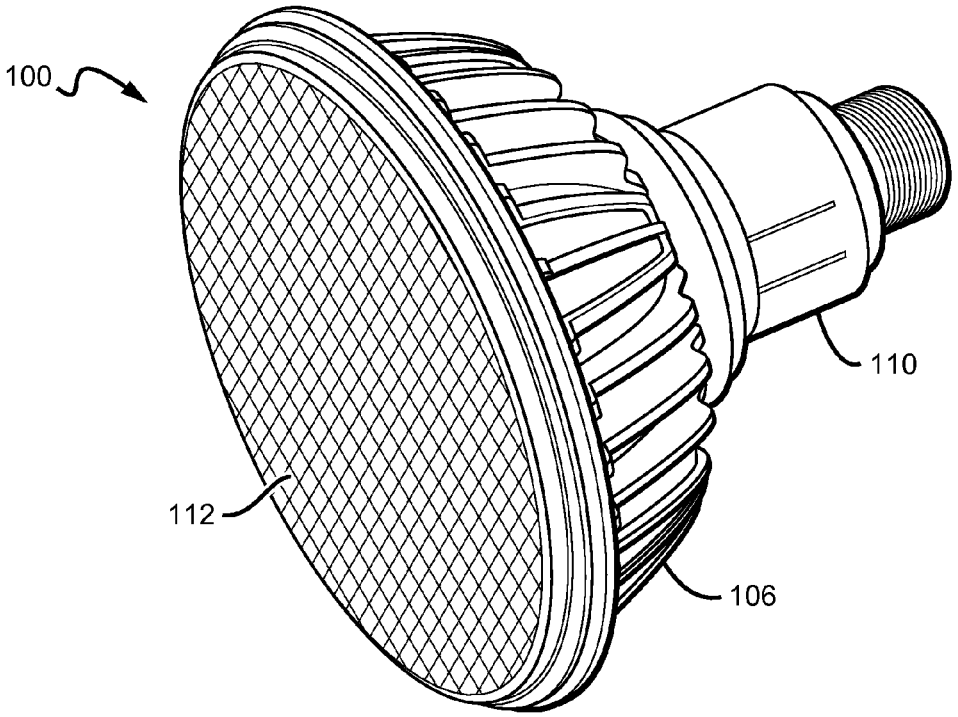

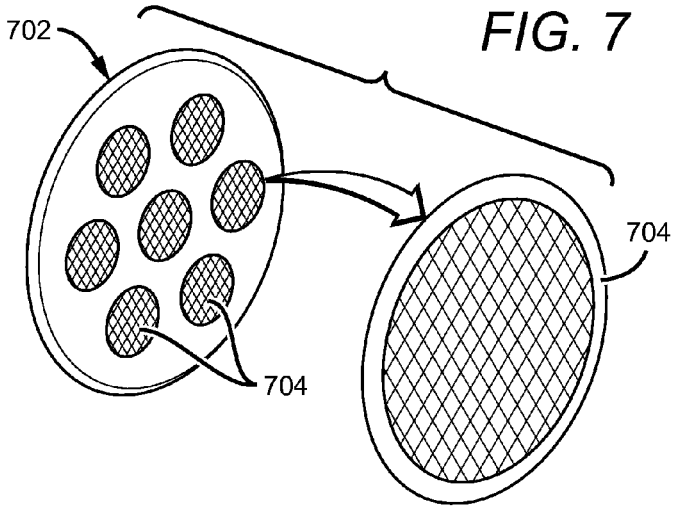
FIG. 7
FIG. 8
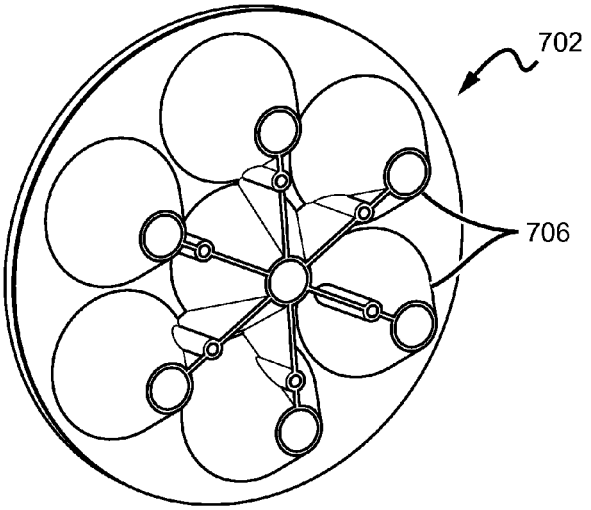
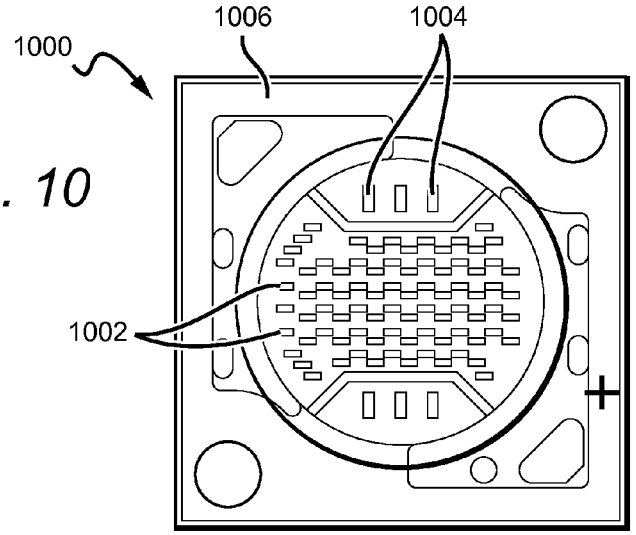
FIG. 10

VARIABLE BEAM ANGLE DIRECTIONAL LIGHTING FIXTURE ASSEMBLY

BACKGROUND OF THE INVENTION

1. Field of the Invention

The invention relates generally to optical assemblies for lighting applications and, more particularly, to variable beam angle fixture assemblies for solid state light sources.

2. Description of the Related Art

Light emitting diodes (LED or LEDs) are solid state devices that convert electric energy to light, and generally comprise one or more active regions of semiconductor material interposed between oppositely doped semiconductor layers. When a bias is applied across the doped layers, holes and electrons are injected into the active region where they recombine to generate light. Light is emitted from the active region and from surfaces of the LED.

In order to generate a desired output color, it is sometimes necessary to mix colors of light which are more easily produced using common semiconductor systems. Of particular interest is the generation of white light for use in everyday lighting applications. Conventional LEDs cannot generate white light from their active layers; it must be produced from a combination of other colors. For example, blue emitting LEDs have been used to generate white light by surrounding the blue LED with a yellow phosphor, polymer or dye, with a typical phosphor being cerium-doped yttrium aluminum garnet (Ce:YAG). The surrounding phosphor material "down-converts" some of the blue light, changing its color to yellow. Some of the blue light passes through the phosphor without being changed while a substantial portion of the light is down-converted to yellow. The LED emits both blue and yellow light, which combine to provide a white light.

In another known approach light from a violet or ultraviolet emitting LED has been converted to white light by surrounding the LED with multicolor phosphors or dyes. Indeed, many other color combinations have been used to generate white light.

Because of the physical arrangement of the various source elements, multicolor sources often cast shadows with color separation and provide an output with poor color uniformity. For example, a source featuring blue and yellow sources may appear to have a blue tint when viewed head-on and a yellow tint when viewed from the side. Thus, one challenge associated with multicolor light sources is good spatial color mixing over the entire range of viewing angles.

One known approach to the problem of color mixing is to use a diffuser to scatter light from the various sources; however, a diffuser usually results in a wide beam angle. Diffusers may not be feasible where a narrow, more controllable directed beam is desired.

Another known method to improve color mixing is to reflect or bounce the light off of several surfaces before it is emitted. This has the effect of disassociating the emitted light from its initial emission angle. Uniformity typically improves with an increasing number of bounces, but each bounce has an associated loss. Many applications use intermediate diffusion mechanisms (e.g., formed diffusers and textured lenses) to mix the various colors of light. These devices are lossy and, thus, improve the color uniformity at the expense of the optical efficiency of the device.

Many modern lighting applications demand high power LEDs for increased brightness. High power LEDs can draw large currents, generating significant amounts of heat that must be managed. Many systems utilize heat sinks which must be in good thermal contact with the heat-generating light sources. Some applications rely on cooling techniques such as heat pipes which can be complicated and expensive.

Recent lighting luminaire designs have incorporated LEDs into lamp modules. There are several design challenges associated with the LED-based lamp modules including: source size, heat management, overall size of the lamp assembly, and the efficiency of the optic elements. Source size is important because the size of a 2 pi emitter dictates the width of the output beam angle (i.e., etendue) using a standard aperture, such as a 2 inch (MR16) aperture, for example. Heat dissipation is a factor because, as noted above, the junction temperature of LEDs must be kept below a maximum temperature specified by the manufacturer to ensure optimal efficacy and lifetime of the LEDs. The overall size of the optical assembly is important because ANSI standards define the physical envelope into which a lamp must fit to ensure compliance with standard lighting fixtures. Lastly, the efficiency of the optic elements must be high so that the output from high-efficacy LEDs is not wasted on inefficient optics.

To address the issue of overall optical assembly size, total internal reflection (TIR) lenses have been used in lamp packages. In many implementations, additional beam-shaping optics are attached to the TIR with a lens carrier. The lens carrier may be attached to the TIR using various methods such as a two-piece trap or heat staking, for example. The TIR/lens carrier component requires early configuration in the assembly process. Additionally, customers cannot easily adjust these lamps for different beam-angle outputs. Each light source is associated with a collimator to collimate light as it is initially emitted from the source.

SUMMARY OF THE INVENTION

An embodiment of a directional lighting system comprises the following elements. A collimator is within a housing. A removable transmissive cover is proximate to the collimator. The cover comprises micro lenses shaped to determine an outgoing beam angle.

An embodiment of a directional lighting system comprises the following elements. A housing comprises a base. At least one light source is on a mount surface of the base. A collimator is arranged to receive light emitted from the light source and collimate the light. A removable cover is proximate to the collimator. The cover comprises micro lenses shaped to determine the beam of angle of light exiting the open end of the housing.

An embodiment of a fixture assembly comprises the following elements. A housing defines an interior cavity and an open end and comprises a base. A plurality of light emitting diodes (LEDs) is on a mounting surface of the base in the cavity. A plurality of collimators is in the cavity, each of the collimators arranged to collimate light from at least one of the LEDs toward the open end of the housing. A removable cover is on the open end of the housing, the removable cover comprising micro lenses shaped to determine the beam angle of light exiting the open end of the housing.

BRIEF DESCRIPTION OF THE DRAWINGS

FIG. 1 is a cross-sectional view of a fixture assembly according to an embodiment of the present invention.

FIG. 2 is a perspective view of a fixture assembly according to an embodiment of the present invention.

FIG. 7 is a perspective view of a cover and a close-up of one micro lens element that may be used in fixture assemblies according to embodiments of the present invention.

FIG. 8 is a perspective view of the back side of a cover and collimators that may be used in fixture assemblies according to embodiments of the present invention.

FIG. 10 is a top perspective view of a chip-on-board (COB) element that may be used in fixtures according to embodiments of the present invention.

DETAILED DESCRIPTION OF THE INVENTION

Figure 3:
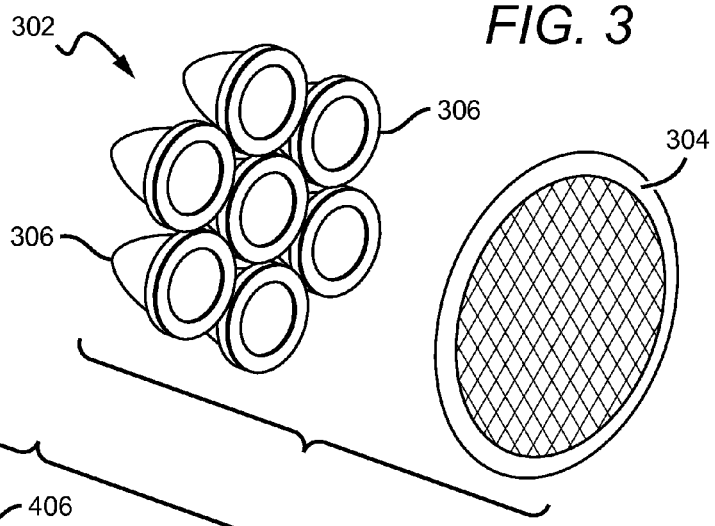
FIG. 3 is an exploded perspective view of a plurality of collimators and a cover that may be used in fixture assemblies according to embodiments of the present invention.

Embodiments of the present invention provide a directional lighting fixture having a variable beam angle that is easily adjusted. A fixture housing is shaped to define an interior cavity and an open end. One or more lighting sources are disposed within the cavity. A removable transmissive cover is disposed over the open end of the housing. The cover comprises a micro lens structure that defines the beam angle of the light that is emitted from the fixture. The removable cover can be easily replaced by the end user with a different cover to achieve a desired beam angle.

It is understood that when an element is referred to as being "on" another element, it can be directly on the other element or intervening elements may also be present. Furthermore, relative terms such as "inner", "outer", "upper", "above", "lower", "beneath", and "below", and similar terms, may be used herein to describe a relationship of one element to another. It is understood that these terms are intended to encompass different orientations of the device in addition to the orientation depicted in the figures.

Although the ordinal terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention.

As used herein, the term "source" can be used to indicate a single light emitter or more than one light emitter functioning as a single source. For example, the term may be used to describe a single blue LED, or it may be used to describe a red LED and a green LED in proximity emitting as a single source. Thus, the term "source" should not be construed as a limitation indicating either a single-element or a multi-element configuration unless clearly stated otherwise.

The term "color" as used herein with reference to light is meant to describe light having a characteristic average wavelength; it is not meant to limit the light to a single wavelength. Thus, light of a particular color (e.g., green, red, blue, yellow, etc.) includes a range of wavelengths that are grouped around a particular average wavelength. Light of a particular color may also be characterized by a specific combination of discrete wavelengths that, in combination, exhibit the particular color.

FIG. 1 is a cross-sectional view of a fixture assembly 100 according to an embodiment of the present invention. FIG. 2 is a perspective view of the fixture assembly 100. In this particular embodiment, seven collimators 102 are positioned over light sources 104 each of which are mounted within a protective housing 106. A Collimator is any device that narrows the incoming beam of light such that the outgoing light disperses more slowly as it propagates; collimators include lenses and reflective structures, for example. In some embodiments, LED light sources are used which may include individual encapsulants 108 over each source to protect the LED and to perform other functions. For example, the encapsulants 108 can be designed to function as diffusers or wavelength converters. The collimators 102 cooperate with encapsulants 108 such that a substantial portion of the light emitted from the sources 104 enter into the collimators 102. Each source 104 may comprise one or more emitter chips which can emit the same or different colors.

The protective housing 106 surrounds the collimators 102 and the sources 104 to shield these internal components from the elements. A portion of the housing 106 may comprise a material that is a good thermal conductor, such as aluminum or copper. The thermally conductive portion of the housing 106 can function as a heat sink by providing a path for heat from the sources 104 through the housing 106 into the ambient. In some embodiments the housing 106 can comprise heat dissipating features such as fins or heat pipes. In other embodiments the housing 106 can comprise different types of lamp collars that can be mounted to a different feature such as a separate heat sink. The sources 104 are disposed at the base of the housing 106 in good thermal contact with the body of the housing 106. Thus, the sources 104 may comprise high power LEDs that generate large amounts of heat. Although in this particular embodiment the light sources 104 comprise individual LED components, other embodiments may comprise multi-chip elements such as a chip-on-board (COB) element, for example, as discussed in more detail herein.

Power is delivered to the sources 104 through a protective conduit 110. The fixture 100 may be powered by a remote source connected with wires running through the conduit 110, or it may be powered internally with a battery that is housed within the conduit 110. The conduit 110 may be threaded as shown in FIG. 2 for mounting to an external structure. In one embodiment, an Edison screw shell may be attached to the threaded end to enable the fixture 100 to be used in a standard Edison socket. Other embodiments can include custom connectors such as a GU24 style connector, for example, to bring AC power into the fixture 100. The device may also be mounted to an external structure in other ways.

The conduit 110 functions not only as a structural element, but may also provide electrical isolation for the high voltage circuitry that it houses which helps to prevent shock during installation, adjustment, and replacement. The conduit 110 may comprise an insulative and flame retardant thermoplastic or ceramic, although other materials may be used.

A transmissive removable cover 112 may be placed over the collimators 104 at the open end of the housing 106. The cover 112 and the housing 106 may form a watertight seal to keep moisture from entering into the internal areas of the fixture 100. The cover 112 is easily removable and attachable to the open end of the housing 106. Thus, several different covers 112, each having different optical properties, may be used with the fixture 100 to change the appearance of the output beam.

The cover 112 may be removably attached to the housing several different structures. In one embodiment, the cover 112 and housing 106 comprise snap-fit structures so that the cover 112 may be easily removed and reattached to the housing 106. The snap-fit attachment mechanism makes it easy for a vendor or an end user to switch out various covers to produce a desired output effect. It is understood that the cover 112 may be attached to the housing 106 with other mechanisms such as screws, latches, or adhesives, for example.

The cover 112 comprises a micro lens structure 114. The micro lens structures may be distributed across the entire face of the cover 112 or may be confined to specific areas. Additionally, the micro lens structures can be uniform or non-uniform across the face of the cover 112 as discussed in more detail herein. Many different known micro lens structures may be used to achieve an output beam having particular characteristics. For example, the micro lenses 114 may be designed to produce a desired output beam angle (i.e., to control beam divergence). In one embodiment, removable covers 112 comprising different micro lens structures 114 can respectively produce beam angles of 12 degrees, 25 degrees, or 40 degrees, for example. Nearly any desired beam angle can be achieved using different known micro lens structures.

The micro lens structure 114 shown in FIG. 1 is merely illustrative; it is not meant to represent the actual contour or shape of any real micro lens structure. Thus, it is understood that many different micro lens structures may be used in embodiments of the present invention.

The cover 112 comprises a flat outer surface 116 to facilitate maintenance and cleaning. In this particular embodiment, the micro lens structure 114 is uniform and covers the entire area of the cover 112. In other embodiments, it may be more efficient to limit the micro lens structure to a particular area or areas of the cover 112 as discussed in more detail herein.

FIG. 3 is an exploded perspective view of a plurality of collimators 302 and a cover 304 that may be used in fixture assemblies according to embodiments of the present invention. In this particular embodiment, the collimators 304 comprise reflector cups 306 that would align with individual light sources in a multi-source configuration. In other embodiments, the fixture may only require a single reflector cup to align with a single source. The reflector cups 306 comprise a reflective interior surface. Thus, the cups 306 may be fabricated using aluminum, another metal, or any other substantially specularly reflective material, for example. The cups 306 may also be made of one material and then finished with a substantially specular material on the interior surface, such as a metal coating, for example.

Figure 4:
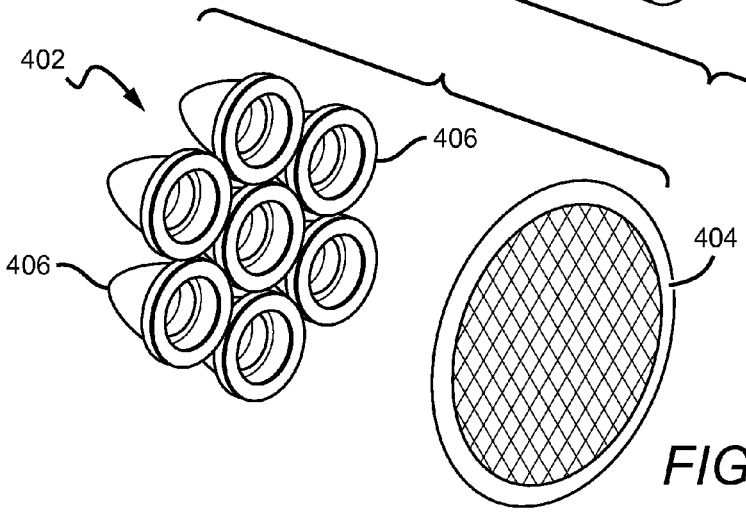
FIG. 4 is an exploded perspective view of a plurality of collimators and a cover that may be used in fixture assemblies according to embodiments of the present invention.

FIG. 4 is an exploded perspective view of a plurality of collimators 402 and a cover 404 that may be used in fixture assemblies according to embodiments of the present invention. In this embodiment, each collimator 402 comprises a TIR lens 406. Many different TIR lens shapes can be used to produce initial collimated beams having particular characteristics. The TIR lenses 406 may be constructed from a typical material such as poly(methyl methacrylate) (PMMA) or from materials having a higher refractive index including various polymeric materials such as PMMAs, polycarbonates (PCs), cyclic olyphan copolymers (COC), or various types of glass. Other materials may also be used.

Figure 5:
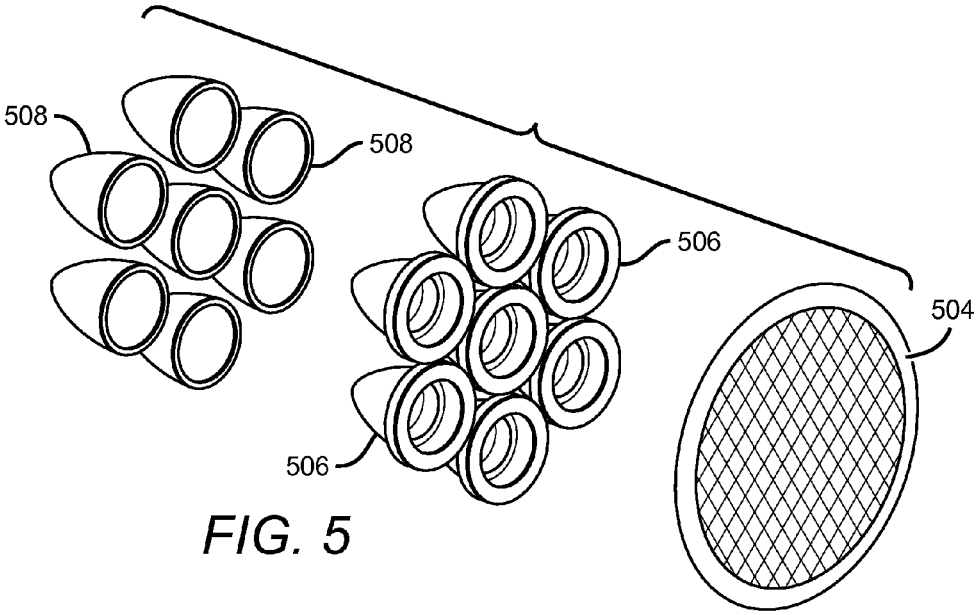
FIG. 5 is an exploded perspective view of a plurality of collimators and a cover that may be used in fixture assemblies according to embodiments of the present invention.

FIG. 5 is an exploded perspective view of a plurality of collimators 502 and a cover 504 that may be used in fixture assemblies according to embodiments of the present invention. Here, the collimators 502 comprise individual TIR lenses 506 inside respective reflector cups 508. In this configuration, the TIR lenses 506 provide most of the collimation with the reflector cups 508 redirecting any light that escapes the TIR lens 506 (e.g., light that impinges the TIR lens 506 at an angle greater than the critical angle for a given material).

Because, in this embodiment, most of the collimation is done with the TIR lenses 506, it may be desirable to use a diffuse material on the interior surface of the reflector cups 508. Thus, in embodiments using the TIR lens/reflector cup combination similar to the one shown in FIG. 5, a diffuse white reflector such as a microcellular polyethylene terephthalate (MCPET) material or a Dupont/WhiteOptics material, for example, may be incorporated into the reflector cups 508. Other white diffuse reflective materials can also be used. Such materials may be applied as a coating to the interior surface of the reflector cups 508.

Diffuse reflective coatings have the inherent capability to mix light from solid state light sources having different spectra (i.e., different colors). These coatings are particularly well-suited for multi-source designs where two different spectra are mixed to produce a desired output color point. For example, LEDs emitting blue light may be used in combination with LEDs emitting yellow (or blue-shifted yellow) light to yield a white light output. A diffuse reflective coating may eliminate the need for additional spatial color-mixing schemes that can introduce lossy elements into the system; although, in some embodiments it may be desirable to use a diffuse coating on the interior surface of the reflector cup 306 in combination with other diffusive elements. In some embodiments, the cup interior surface may be coated with a phosphor material that converts the wavelength of at least some of the light from the light emitting diodes to achieve a light output of the desired color point.

Figure 6:
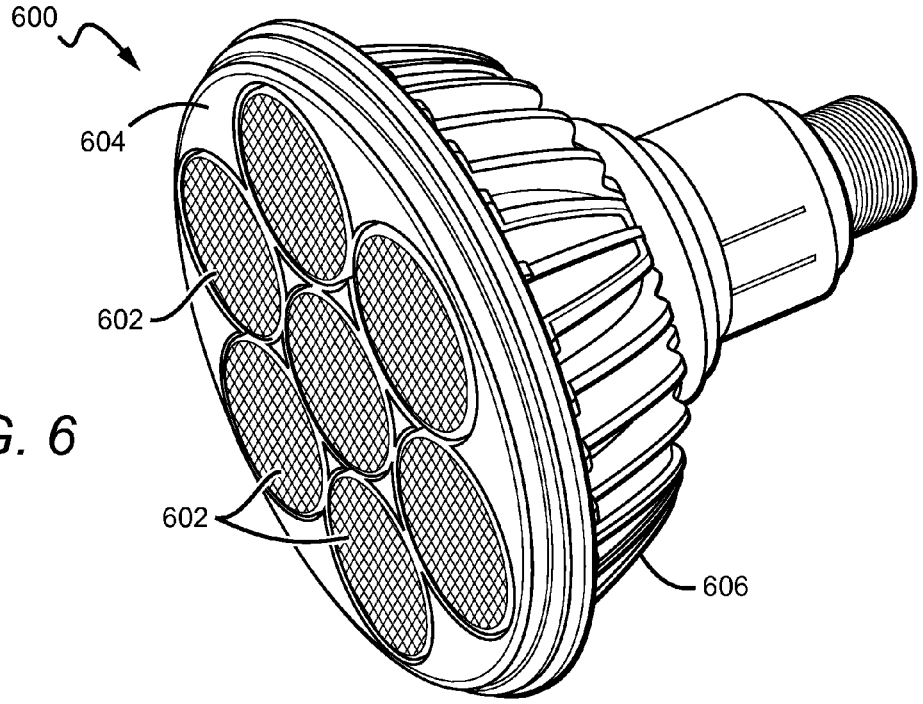
FIG. 6 is a perspective view of fixture assembly according to an embodiment of the present invention.

FIG. 6 is a perspective view of fixture assembly 600 according to an embodiment of the present invention. The fixture 600 is similar to the fixture 100 shown in FIG. 1. However, in this embodiment the micro lenses 602 are confined to areas of a cover 604 that align with the collimators (not shown in this figure) that are disposed inside the housing 606. This configuration reduces the amount of micro lens material necessary by eliminating material in areas that do no align with the collimators, possibly reducing the total cost of the fixture 600. Several known mechanisms may be used to ensure proper alignment of the collimators and the associated micro lenses 602, such as a notch/key mechanism (not shown), for example.

FIG. 7 is a perspective view of a cover 702 and a close-up of one micro lens element 704 that may be used in fixture assemblies according to embodiments of the present invention. Several micro lens elements 704 are positioned in associated cutout portions of the cover 702 such that they align with the collimators in the housing. When the micro lens elements are disposed in the cutout portions, the cover itself may be light transmissive or opaque. In some embodiments, it may be desirable to have micro lens elements 704 with different properties.

FIG. 8 is a perspective view of the back side of the cover 702. Several collimators 706 are mounted to the cover 702 over the cutout portions such that they align with the micro lenses 704 visible from the other side of the cover 702. Here, the collimators 706 comprise reflector cups similar to the embodiment shown in FIG. 3. In this embodiment, the cover 702 is designed to cooperate with a lamp having seven discrete light sources; other fixture embodiments may have a different number of sources, such as the fixture shown in FIG. 9.

Figure 9:
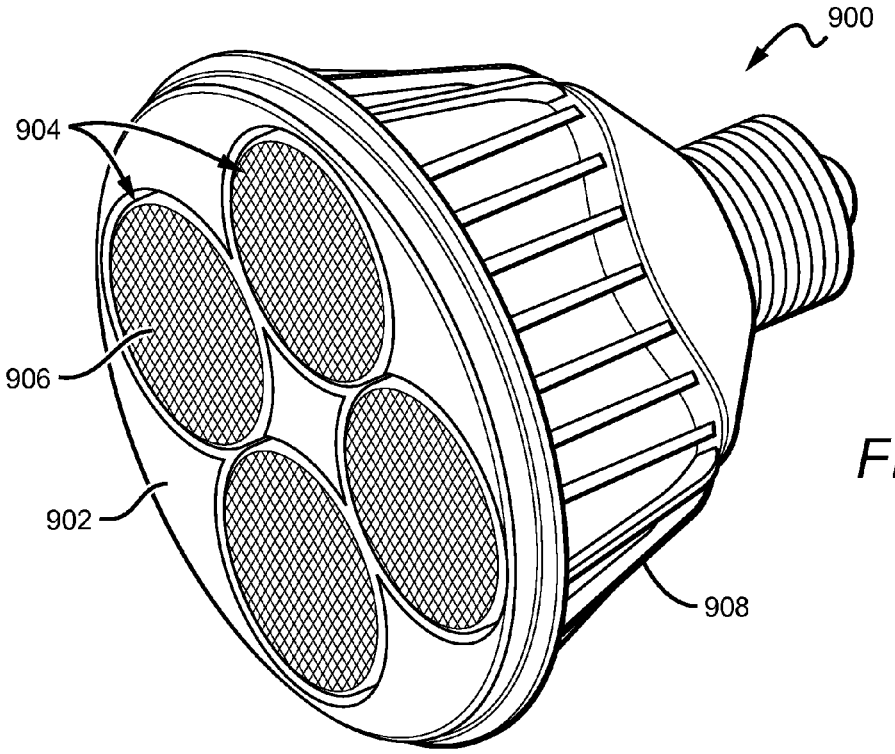
FIG. 9 is a perspective view of a fixture assembly according to an embodiment of the present invention.

FIG. 9 is a perspective view of a fixture assembly 900 according to an embodiment of the present invention. This particular embodiment comprises a cover 902 with four cutout portions 904 to accommodate the micro lenses 906. The housing 908 surrounds and protects the four discrete light sources (not shown) inside. Thus, it is understood that many different light source configurations can be used with embodiments of the present invention.

In some embodiments, individual LED sources may be replaced with LEDs that are clustered in a given area(s) using a chip-on-board (COB) configuration as mentioned briefly with reference to FIG. 1. Thus, each discrete source may comprise several LEDs and the circuitry necessary to drive them in a single element. FIG. 10 is a top perspective view of a COB element 1000 that may be used in fixtures according to embodiments of the present invention. The COB element 1000 comprises several LEDs of first color 1002 and LEDs of a second color 1004 all mounted to a thermally conductive board 1006. On-board elements provide circuitry that can power multiple high voltage LEDs. The element 1000 may be easily mounted to many surfaces within the fixture. COB provides several advantages over traditional individually packaged LEDs. One advantage is the removal of a thermal interface from between the chip and the ambient environment. A substrate element, which may be made of alumina or aluminum nitride, may be removed as well resulting in a cost saving. Process cost may also be reduced as the singulation process necessary to separate individual LED dice is eliminated from the work stream.

Figure 11:
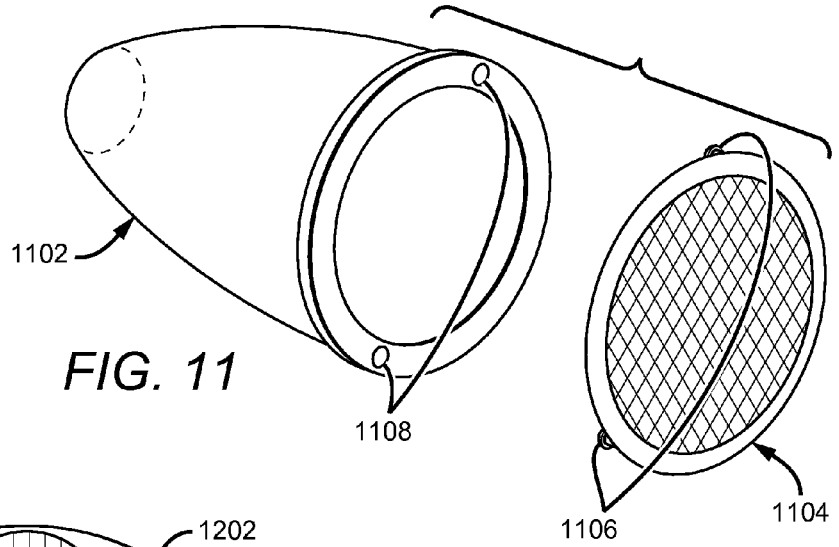
FIG. 11 is an exploded view of a collimator/micro lens assembly that may be used in lighting systems according to embodiments of the present invention.

FIG. 11 shows an individual assembly 1100 comprising a collimator 1102 and micro lens element 1104 that may be used in lighting systems according to embodiments of the present invention. As shown, the collimator 1102 and the micro lens element 1104 can be joined using a snap-fit structure, including posts 1106 and holes 1108. It is understood that micro lens element 1104 may be attached to the collimator 1102 with other mechanisms such as screws, latches, or adhesives, for example.

Figure 12:
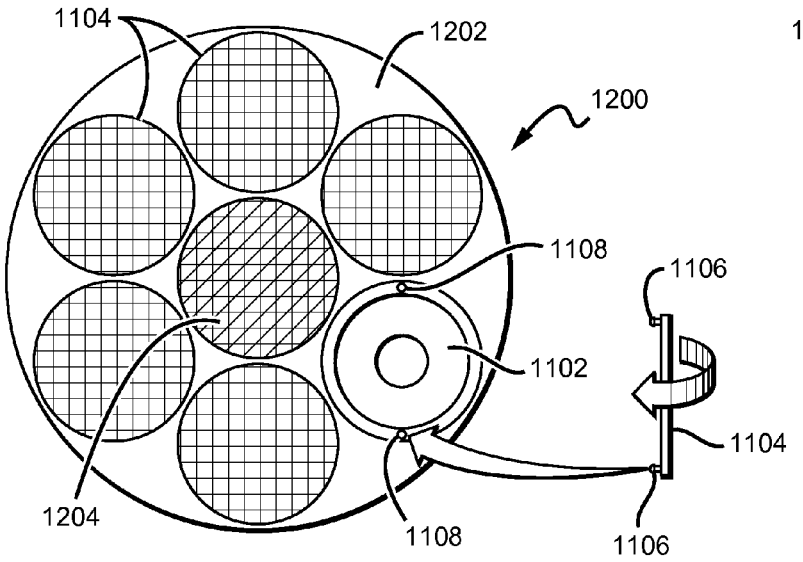
FIG. 12 is a front perspective view a cover that may be used in lighting systems according to embodiments of the present invention.

FIG. 12 is a front perspective view of a cover 1200 for use in lighting systems according to embodiments of the present invention. This particular cover 1200 comprises a light transmissive body 1202 and may be used with the collimator 1102 and micro lens element 1104 shown in FIG. 11. The emission end of the collimator 1102 is flush with cutout portion of the cover 1200 as shown. Each individual micro lens element 1104 is removably attached to a respective collimator 1102. In this embodiment, the micro lens elements 1104 mate with the collimators 1102 using a snap-fit post 1106 and hole 1108 structure. A side view of one of the micro lens elements 1104 which has been removed is shown such that the posts 1106 and holes 1108 are visible. In this way, the micro lens elements 1104 are easily removable and replaceable, allowing for customized lens arrangements such as that shown in FIG. 12. For example, the embodiment shown in FIG. 12 includes six micro lens elements 1104 of a first type surrounding a central micro lens 1204 of a second type. Thus, the micro lens structure is non-uniform across the face of the cover 1200. Lenses having various properties and fabricated from various materials can be easily used in combination to achieve a particular output profile. Many different arrangements are possible.

Figure 13:
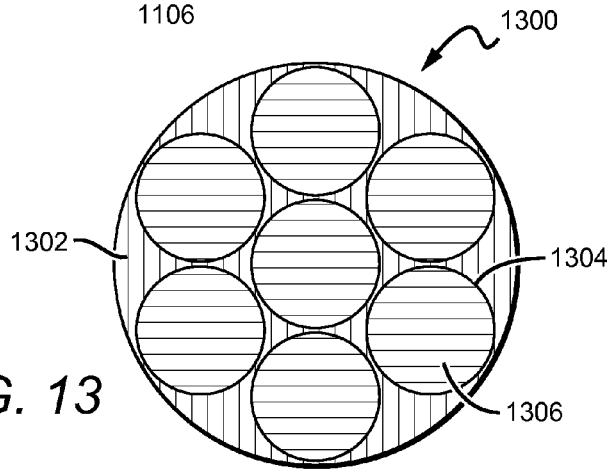
FIG. 13 is a front perspective view of a cover that may be used in lighting systems according to embodiments of the present invention.

FIG. 13 is a front perspective view of a cover 1300 that may be used in lighting systems according to embodiments of the present invention. In this particular embodiment, the body 1302 of the cover is light transmissive and comprises micro lens features across the entire face. The body 1302 also comprises cutout portions 1304 with micro lens elements 1306 disposed within the cutout portions 1304 as shown. In some embodiments, the micro lens elements 1306 have different optical properties than the surrounding body 1302 such that the micro lens structure is non-uniform across the face of the cover 1300. Thus, it is possible to customize the body 1302 and micro lens element 1306 combinations to achieve a desire output profile.

It is understood that embodiments presented herein are meant to be exemplary. Embodiments of the present invention can comprise any combination of compatible features shown in the various figures, and these embodiments should not be limited to those expressly illustrated and discussed.

Although the present invention has been described in detail with reference to certain configurations thereof, other versions are possible. Therefore, the spirit and scope of the invention should not be limited to the versions described above.

We claim:

1. An assembly for directional lighting, comprising:
a housing;
a plurality of collimators within said housing; and
a transmissive cover which is removably mounted over said plurality of collimators, said cover comprising a plurality of micro lenses, all of which are co-planar and shaped to determine a desired outgoing beam angle, said cover proximate to said collimators without substantially extending into said collimators.

2. The assembly for directional lighting of claim 1, wherein each of said collimators comprises a total internal reflection (TIR) lens.

3. The assembly for directional lighting of claim 1, wherein each of said collimators comprises a reflector cup.

4. The assembly for directional lighting of claim 3, wherein each of said reflector cups comprises a substantially specularly reflective material.

5. The assembly for directional lighting of claim 3, wherein each of said reflector cups comprises a highly reflective material.

6. The assembly for directional lighting of claim 3, wherein each of said reflector cups is metal-coated.

7. The assembly for directional lighting of claim 1, further comprising respective reflector cups around each of said collimators.

8. The assembly for directional lighting of claim 1, wherein said cover is removably mounted to said housing with a snap-fit structure.

9. The assembly for directional lighting of claim 1, wherein an outer surface of said cover is flat, said outer surface opposite said collimators.

10. The assembly for directional lighting of claim 1, wherein said plurality of micro lenses are dispersed across the entire area of said cover.

11. The assembly for directional lighting of claim 1, wherein said plurality of micro lenses are confined to an area of said cover that aligns with at least one of said collimators.

12. The assembly for directional lighting of claim 1, wherein said plurality of micro lenses are non-uniform across the face of said cover.

13. The assembly for directional lighting of claim 1, wherein said cover is shaped to define cutout portions with said plurality of micro lenses therein.

14. The assembly for directional lighting of claim 13, wherein said plurality of micro lenses connect to at least one of said collimators.

15. A directional lighting system, comprising:

a housing comprising a base;

at least one light source on a mount surface of said base;

a plurality of collimators configured to receive light emitted from said light source and collimate said light; and a cover which is removably mounted over said plurality of collimators, said cover comprising a plurality of micro lenses, all of which are co-planar and shaped to determine a desired beam angle of light exiting said lighting system, said cover proximate to said collimators without substantially extending into said collimators.

16. The directional lighting system of claim 15, wherein each of said collimators comprises a total internal reflection (TIR) lens.

17. The directional lighting system of claim 15, wherein each of said collimators comprises a reflector cup.

18. The directional lighting system of claim 17, wherein each of said reflector cups comprises a substantially specularly reflective material.

19. The directional lighting system of claim 17, wherein each of said reflector cups comprises a highly reflective material.

20. The directional lighting system of claim 17, wherein each of said reflector cups is metal-coated.

21. The directional lighting system of claim 15, further comprising a reflector cup around each of said collimators.

22. The directional lighting system of claim 15, wherein said cover is removably mounted to said housing with a snap-fit structure.

23. The directional lighting system of claim 15, wherein an outer surface of said cover is flat, said outer surface opposite said collimators.

24. The directional lighting system of claim 15, wherein said plurality of micro lenses are dispersed across the entire area of said cover.

25. The directional lighting system of claim 15, wherein said plurality of micro lenses are confined to an area of said cover that aligns with at least one of said collimators.

26. The directional lighting system of claim 15, wherein said plurality of micro lenses are non-uniform across a face of said cover.

27. The directional lighting system of claim 15, wherein said cover is shaped to define cutout portions with said plurality of micro lenses therein.

28. The directional lighting system of claim 27, wherein said plurality of micro lenses connect to at least one of said collimators.

29. A fixture assembly, comprising:

a housing defining an interior cavity and an open end, said housing comprising a base;

a plurality of light emitting diodes (LEDs) on a mounting surface of said base in said cavity;

a plurality of collimators in said cavity, each of said collimators configured to collimate light from at least one of said LEDs toward said open end of said housing; and a cover which is removably mounted on said open end of said housing and proximate to at least one collimator in said plurality of collimators without substantially extending into said at least one collimator, said cover comprising a plurality of micro lenses, all of which are co-planar and shaped to determine the beam angle of light exiting said open end of said housing.

30. The fixture assembly of claim 29, wherein each of said collimators comprises a total internal reflection (TIR) lens.

31. The fixture assembly of claim 29, wherein each of said collimators comprises a reflector cup.

32. The fixture assembly of claim 31, wherein each of said reflector cups comprises a substantially specularly reflective material.

33. The fixture assembly of claim 31, wherein each of said reflector cups comprises a highly reflective material.

34. The fixture assembly of claim 31, wherein an interior surface of each of said reflector cups is metal-coated.

35. The fixture assembly of claim 29, further comprising a reflector cup around each of said collimators.

36. The fixture assembly of claim 29, wherein said cover is removably mounted to said housing with a snap-fit structure.

37. The fixture assembly of claim 29, wherein an outer surface of said cover is flat, said outer surface opposite said cavity.

38. The fixture assembly of claim 29, wherein said plurality of micro lenses are dispersed across the entire area of said cover.

39. The fixture assembly of claim 29, wherein said plurality of micro lenses are confined to areas of said cover that align with said collimators.

* * * * *